US007501770B2

(12) United States Patent
Tuli

(10) Patent No.: US 7,501,770 B2
(45) Date of Patent: Mar. 10, 2009

(54) LASER GUIDED DISPLAY DEVICE

(76) Inventor: Raja Singh Tuli, 1155 Rene Levesque West, Suite #3500, Montreal, Quebec (CA), H3B 3T6

( * ) Notice: Subject to any disclaimer, the term of this patent is extended or adjusted under 35 U.S.C. 154(b) by 0 days.

(21) Appl. No.: 09/918,523

(22) Filed: Aug. 1, 2001

(65) Prior Publication Data

US 2003/0025458 A1 Feb. 6, 2003

(51) Int. Cl.
*G09G 3/10* (2006.01)

(52) U.S. Cl. ..... 315/169.3; 315/169.1; 345/76; 345/77

(58) Field of Classification Search ..... 315/169.1, 315/169.2, 169.3, 169.4; 345/55, 76, 77, 345/84

See application file for complete search history.

(56) References Cited

U.S. PATENT DOCUMENTS

| | | | | | |
|---|---|---|---|---|---|
| 4,093,852 | A | | 6/1978 | Olive et al. | |
| 4,562,461 | A | | 12/1985 | Yin | |
| 4,714,956 | A | | 12/1987 | Yin | |
| 4,908,584 | A | * | 3/1990 | Reichman | 349/26 |
| 4,975,776 | A | * | 12/1990 | Takanashi et al. | 348/340 |
| 5,339,118 | A | * | 8/1994 | Tagami | 348/744 |
| 5,528,397 | A | * | 6/1996 | Zavracky et al. | 359/59 |
| 5,717,390 | A | * | 2/1998 | Hasselbring | 2/98 |
| 5,744,790 | A | * | 4/1998 | Li | 235/472 |
| 6,067,308 | A | * | 5/2000 | Leksono et al. | 372/41 |
| 6,356,251 | B1 | * | 3/2002 | Naito et al. | 345/81 |

FOREIGN PATENT DOCUMENTS

GB 2118803 A 11/1983

OTHER PUBLICATIONS

Nakayama K et al, Charge–injection–controlled organic transisitor, Applied Physics Letters, 2003, vol. 82, No. 25, p. 4584.

Nakayama K et al, Photocurrent multiplication at organic/metal interface and surface morphology of organic films, Journal of Applied Physics, 2000, vol. 87, No. 7, p. 3365.

Nakayama K et al, A high speed photocurrent multiplcation device based on an organic double–layered structure, Applied Physics Letters, 2000, vol. 76, No. 9, p. 1194.

Nakayama K et al, Direct tracing of the photocurrent multiplcation process in an organic pigment film, Journal of Applied Physics, 1998, vol. 84, No. 11, p. 6154.

Hiramato M et al, Photocurrent mutiplication in amorphous silicon carbide films, Applied Physics Letters, 1991, vol. 59, No. 16, p. 1992.

Hiramato M et al, Photocurrent mutiplication in organic pigment films, Applied Physics Letters, 1994, vol. 64, No. 2, p. 187.

Hiramato M et al, Spatially addressable light transducer . . . , Applied Physics Letters, 1990, vol. 57, No. 16, p. 1625.

(Continued)

*Primary Examiner*—Tho Phan

(57) ABSTRACT

A laser beam, which scans a display screen comprised of an array of picture elements. Each picture element is further comprised of a photocell connected to an LED in the presence of an electric field. The laser's intensity and or duration on selected photocells produces the desired intensity of LED illumination for that pixel. The photocells convert photons from the laser into a current flow, which is accelerated and amplified by the presence of the electric field. With quantum efficiency significantly greater than one, it is possible to create a RGB color display screen activated by a scanning laser. LEDs may be arranged in an alternating pattern of red, green, and blue to form the color display. The LED may also be monolithic in construction, coated with an alternating pattern of red, green, and blue phosphors to form the color display.

27 Claims, 7 Drawing Sheets

OTHER PUBLICATIONS

Hiramato M et al, Photocurrent mutiplication in organic single crystals, Applied Physics Letters, 2002, vol. 81, No. 8, p. 1500.

Hiramato M et al, Direct measurement of internal potential distribution in organic electrolminescent diodes . . . , Applied Physics Letters, 2000, vol. 76, No. 10, p. 1336.

Hiramato M et al, Field–activated strutural traps at organic pigment/metal interfaces causing photocurrent . . . , Applied Physics Letters, 1998, vol. 73, No. 18, p. 2627.

Hiramoto M et al, Light amplification in a new light transducer combining . . . , Optical Review, 1994, vol. 1, No. 1, p. 82.

Hiramoto M et al, Photocurrent mutiplication phenomena at organic/metal and organic/organic interfaces, Thin Solid Films, 1998, No. 331, p. 71–75.

Katsume T et al, Photocurrent mutiplication in napthalene tetracarboxylic anhydride film at room temprature, Applied Physics Letters, 1996, vol. 69, No. 24, p. 3722.

Tano T et al, Observation of photoassisted electroluminescent . . , Extended Abstarcts 2001 International Conferences on Solid State Devices and Materials, Tokyo, p. 638–639.

Ni J et al, Organic light emitting diode with TiOPc layer . . . , Jpn. J. Appl. Phys., 2001, vol. 40, p. L948–L951.

Katsume T et al, Light amplifcation device using oragnic electroluminescent diode coupled with photoresponsive. . . , Applied Physics Letters, 1995, vol. 66, No. 22, p. 2992.

Katsume T et al, High photon conversion in a light transducer combining oragnic electroluminescent diode . . . , Applied Physics Letters, 1994, vol. 64, No. 19, p. 2546.

Chikamatsu M et al, Light up–conversion from near–infrared to blue using a photoresponsive organic light–emitting device, Applied Physics Letters, 2002, vol. 81, No. 4, p. 769.

Matsunobu G et al, High–speed multiplication–type photodetecting device using organic codeposited films, Applied Physics Letters, 2002, vol. 81, No. 7, p. 1321.

* cited by examiner

LASER GUIDED DISPLAY DEVICE

BACKGROUND OF THE INVENTION

1. Field of the Invention

The invention relates to a laser beam, which scans a display screen comprised of a pixel array of photocells or photo diodes each connected to LED's in the presence of an electric field. The laser's intensity on each photocell produces the desired intensity of LED illumination for that pixel. With a quantum efficiency greater than one, it is possible to create a RGB color display screen activated by a scanning laser. Conventional photodiodes and avalanche photodiodes may all be used in converting the laser's intensity into a current, which is amplified to drive each LED on the display screen.

2. Prior Art

Prior Art of the invention would involve projection type displays vastly different from the present invention, as these do not utilize a scanning laser to energize pixels on the display screen. Other prior art would include active displays, which again do not utilize a scanning laser to energize pixels on the display screen.

SUMMARY OF THE INVENTION

The present invention relates to a display device, capable of a very large screen size, utilizing a scanning laser to drive the display elements. The heart of the invention lies in the composition of each picture element or pixel on a display screen. Pixels are arranged in a matrix array on the display screen such that the laser starts scanning the display screen from one corner, moving across horizontally scanning each line on the display screen. All pixels on the display screen are scanned once per frame period, with the intensity and duration of the laser's beam on each pixel variable, in order to produce a variable depth of color on the display.

Each pixel is comprised of Red (R), Green (G), and Blue (B) Light Emitting Diodes (LEDs), with each color LED connected to a photocell or photodiode in the presence of an applied electric field. The laser's beam is directed at selected photodiodes thus generating electricity in the form of electron-hole pairs which is directed to the connected LEDs of different colors, producing a color display output. The intensity and duration of the laser's beam on each photodiode is proportional to the LED's light output. Hence, by varying the laser's intensity on each photodiode connected to each red, green and blue LED of each pixel, it is possible to produce a true color display.

In another embodiment of the invention, a transistor is utilized comprising a photocell and LED combination. At one end the n-p barrier is highly reversed biased and this assists more electrons migrating across or in the avalanche effect as a result of the applied electric field. Hence, this portion of the transistor acts as a photocell with the opposite end highly forward biased at the p-n barrier, acting as an LED attracting more electrons flowing to it, thus enhancing the current flow. As the scanning laser's light particles or photons strike the photocell region near the barrier, it can strike an atom in the crystal lattice and dislodge an electron. In this way a hole-electron pair is generated which will then migrate under the action of the electric field across the p-n barriers, and recombine with other electrons and holes to generate a light output from the LED. With the applied electric field in the region of the reverse biased n-p barrier, a photo-generated hole or electron can collide with adjacent electron-bonding atoms, breaking the bond, and creating an electron-hole pair further causing an avalanche of carriers due to the electric field, increasing the current flow to the LED producing a high intensity output.

In a further embodiment, the electric field can be manipulated to control the on-off cycles of the display screen. With the electric field applied, the laser is turned on then off for a short duration, during which time a charge is built up in the photocell region. This produces a steady flow of current, which illuminates the LED's, whereby turning off the electric field shuts off the LED's to complete a single frame of the display. At the end of every frame, the electric field is shut off for every pixel, then turned back on prior to the scanning laser passing over each photodiode for the subsequent frame. Once the electric field is turned off the LED's output is also turned off.

In another embodiment of the invention, the electric field is manipulated to turn the LED's on and off for each frame period, utilizing a memory effect within the photocell region of the device. As the laser scans each photocell there is a charge buildup and electron-hole pairs move in all directions away from and towards the n-p barrier. The movement of these electron-hole pairs is of sufficient energy to keep them in motion for the duration the external electric field is turned off, hence creating a memory effect. Once the electric field is applied, the electron-hole pairs accelerate and migrate across the n-p barrier with sufficient energy creating a current flow, thus turning on the LED's to maximum illumination. Cutting off the electric field would reduce the quantum efficiency of the device, turning off the LED's thus ending that particular frame.

BRIEF DESCRIPTION OF THE DRAWINGS

The invention is described in more detail below with respect to an illustrative embodiment shown in the accompanying drawings in which.

DETAILED DESCRIPTION OF THE PREFERRED EMBODIMENTS

To facilitate description, any numeral identifying an element in one figure will represent the same element in any other figure.

Figure 1:
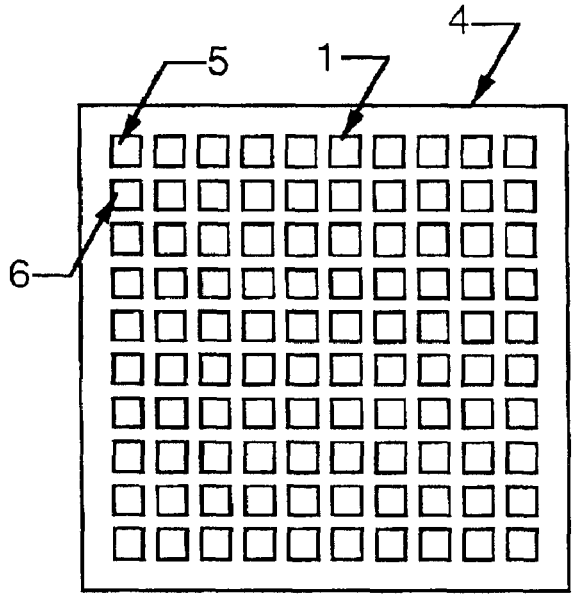
FIG. 1 illustrates the pixels on the display screen in accordance with the present invention.
Figure 2:
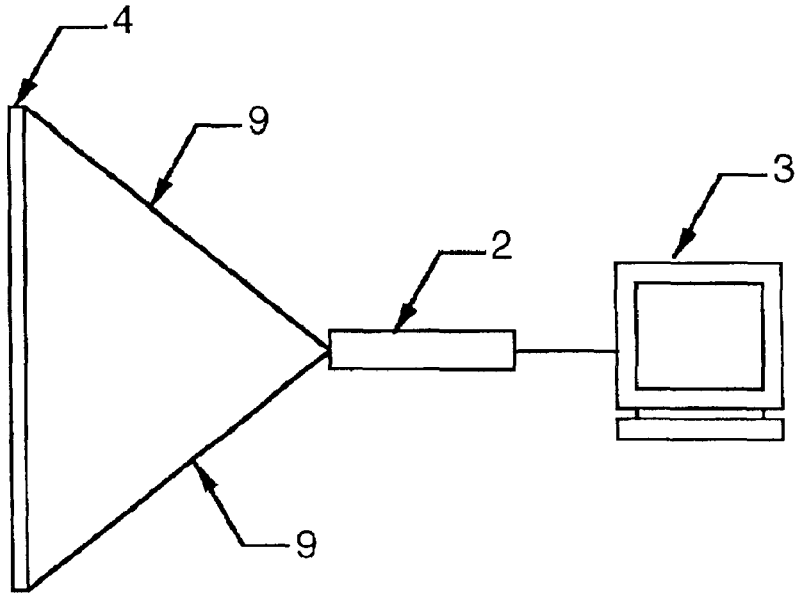
FIG. 2 illustrates a scanning laser applied to the display screen in accordance with the present invention.

The principal embodiment of the present invention aims to provide a display device, capable of a very large screen size, activated by a scanning laser. With reference to FIG. 1, the heart of the invention lies in the composition of each picture element or pixel 1 on a display screen 4. With further reference to FIG. 2, a scanning laser 2 is featured with related microelectronics 3, to guide the laser's beam onto the display screen 4. The pixels 1 are arranged in a matrix array on the display screen such that the laser starts scanning the display screen from one corner, moving across horizontally until that line of pixels is scanned as a row. The laser locates the next pixel 6 below the first pixel 5 in the previous line scanned and proceeds to scan the entire row, completing the scanning of each row of pixels on the display screen 4 for one frame period. With further reference to the principal embodiment of the present invention, all pixels on the display screen are scanned once per frame period, with the intensity and or duration of the laser's beam on each pixel variable, in order to produce a variable depth of color on the display. For demonstration purposes, there may be 30 frames displayed on the screen 4 per second, hence the laser scans each pixel 30 times per second, once per frame period.

In a further embodiment of the present invention, the laser 2 scans all pixels on the display screen as described in the principle embodiment many times per frame period, for each frame. The significance of this method will be described later on.

In another embodiment of the invention, a projector may be used to project an image onto the display screen 4, which is then enhanced by elements in the screen's construction, thereby replacing the laser 2. Thus, the screen acts as a light amplifier in this application.

Figure 3:
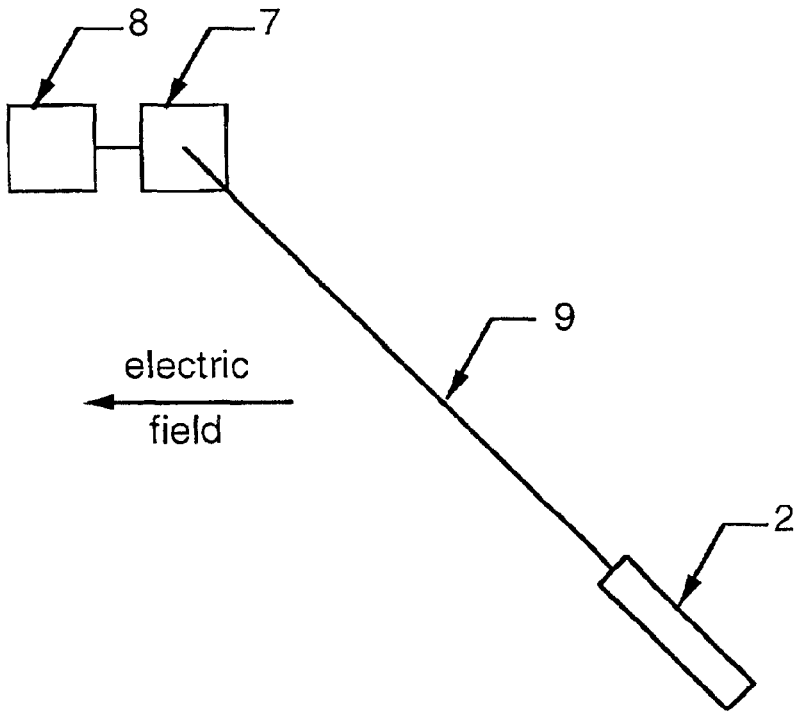
FIG. 3 illustrates the scanning laser directed to a pixel on the screen in accordance with the present invention.
Figure 4:
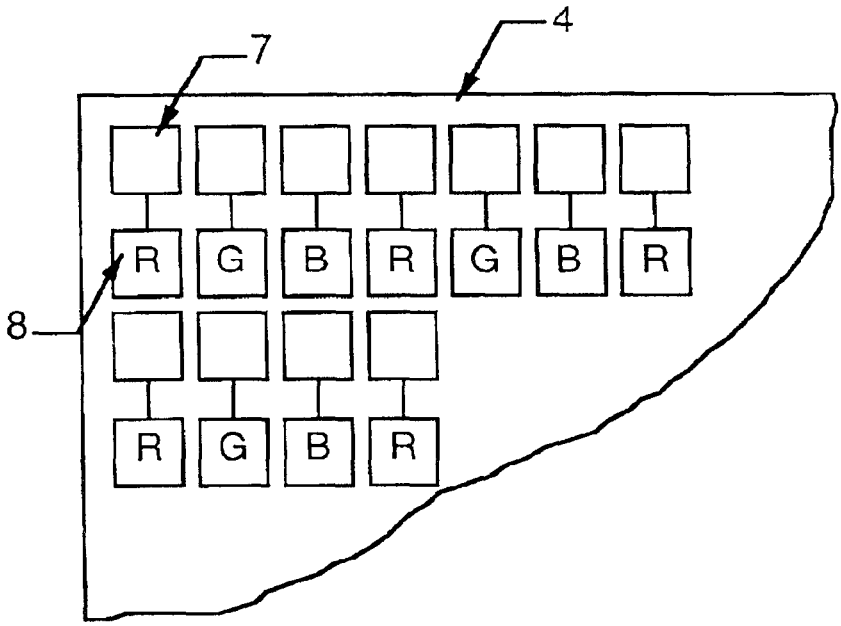
FIG. 4 illustrates the layout of pixels on the screen in accordance with one embodiment of the present invention.

With reference to FIG. 3, this particular embodiment of the present invention basically discloses each pixel comprised of a photocell or photodiode 7 connected to a LED 8 in the presence of an applied electric field. The laser's beam 9 is directed at photodiodes 7 at each pixel location which generate a current in the form of electron-hole pairs, flowing to the connected LED 8 producing a color light output. The intensity and duration of the laser's beam on each photodiode is proportional to the LED's light output. When a light photon from the laser strikes an atom in the crystal lattice in the photodiode, it dislodges an electron. In this way an electron-hole pair is generated. The hole and electron will then migrate in opposite directions under the action of the electric field, and a small current can be seen to flow. The size of the current is proportional to the amount of light entering the photodiode 7. The more light, the greater the numbers of electron-hole pairs that are generated, and the greater the current flow. By arranging the LEDs 8 of pixels within the display screen 4 in groups or patterns of red, green and blue with each group or pattern repeating itself comprising a matrix array, it is possible to create an RGB color display as illustrated in FIG. 4. Hence, by varying the laser's intensity and or duration on each photodiode 7 connected to each red, green and blue LED 8 of each pixel, a color display is generated on the screen 4.

Figure 5:
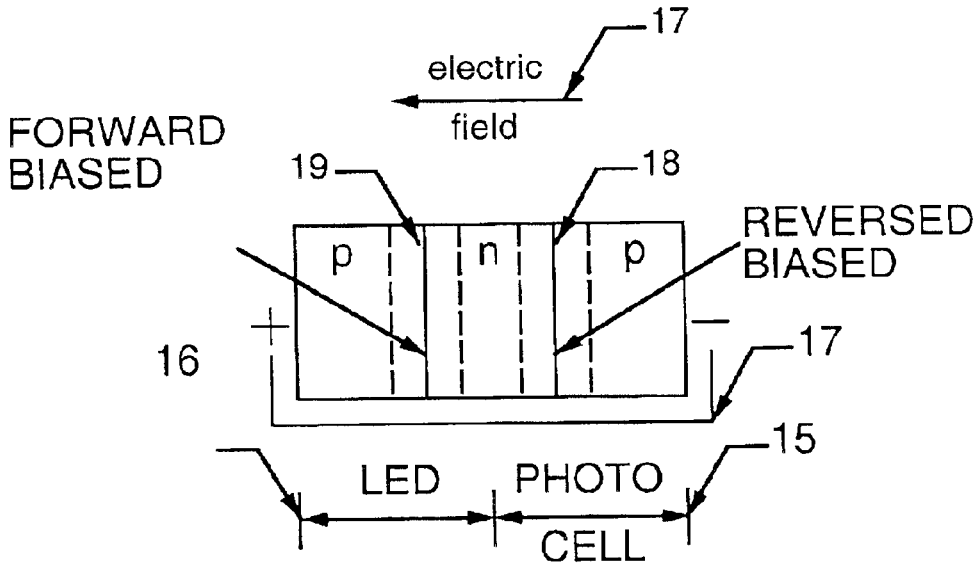
FIG. 5 illustrates a LED-photodiode combination in accordance with the present invention.
Figure 6:
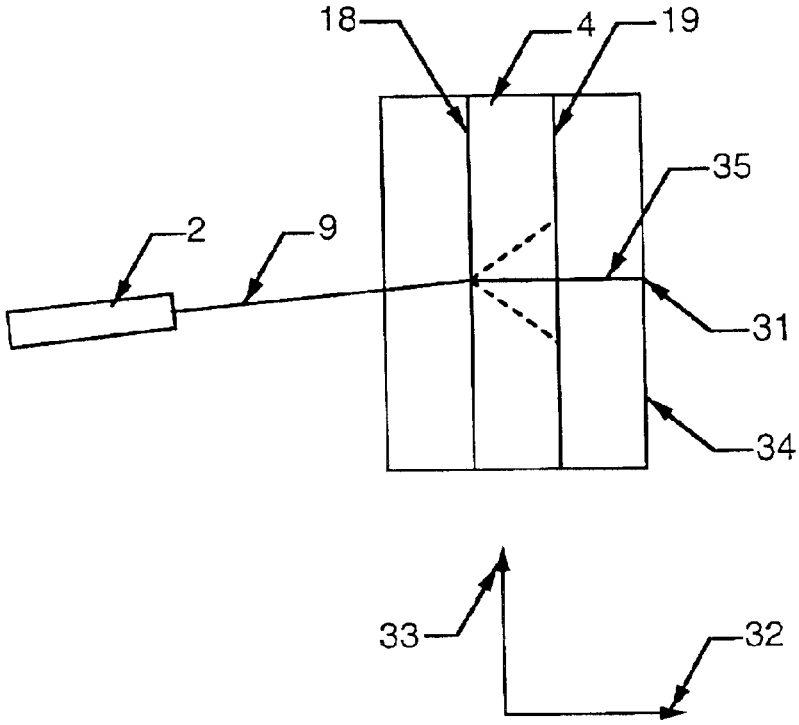
FIG. 6 illustrates the mobility of electron-hole pairs in accordance with the present invention.

In another embodiment of the invention, with reference to FIG. 5, the display device comprises a sandwich type construction, which is primarily a photocell 15 and LED 16 combination, whereby an electric field 17 is applied to the device, which will enhance the current flow once started. At one end, the n-p barrier 18 is highly reversed biased and this assists more electrons migrating across or in the avalanche effect as a result of the applied electric field. Consequently, this portion of the device acts as a photocell 15. The opposite end acts as an LED 16 which is highly forward biased at the p-n barrier 19, attracting more electrons flowing to it, thus enhancing the current flow. As the scanning laser's light particles or photons strike the photocell region near the barrier 18, it can strike an atom in the crystal lattice and dislodge an electron. In this way a hole-electron pair or carrier is generated which will then migrate under the action of the electric field across the barriers 18 and 19, and recombines with other electrons and holes to generate a light output from the LED 16. In another embodiment, the carrier may also be a hole or an electron. With the applied electric field 17 in the region of the reverse biased n-p barrier 18, a photo-generated hole or electron can collide with adjacent electron-bonding atoms, breaking the bond, and creating an electron-hole pair through this process of impact ionization. These newly created pairs can gain enough energy from the electric field 17 to cause further impact ionization until finally an avalanche of carriers is produced, increasing the current flow to the LED 16 producing a high intensity output. With a quantum efficiency greater than one, it is possible to have more than one electron generated for each photon of incident light yielding this high intensity output. With further reference to FIG. 6, as the beam 9 from the laser 2 is directed to strike the screen 4 near the reversed biased barrier 18, electron-hole pairs have a mobility which is higher in direction 32 (perpendicular to display surface 34) compared with direction 33. Hence, electron-hole pairs do not disperse in all directions to produce a large pixel or dot 31 on the display surface 34. Thus, a small concentrated laser beam would yield a small pixel or dot 31 on the display surface 34, and would have no effect on adjacent pixels or dots. Since the display screen 4 would be comprised of semiconductor material, the surface on which the laser's beam 9 first strikes bears properties that do not promote the spreading or dispersion of the laser's beam. These factors yield a high-resolution display device. As the scanning laser's light particles or photons strike the display screen 4 in the photocell region near the barrier 18, a hole-electron pair is generated whereby either the hole or electron migrates under the action of the electric field across the barriers 18 and 19, and recombines at location 35 to generate a light output at the LED region, displayed at location 31 on the display surface 34. This display construction or system has a capacitance which when the laser's beam is applied, a large number of carriers (which are electron-hole pairs) are generated proportionally. Thus, more carriers generated means more light output from the LED region. With this capacitance in the system, the carriers continue to move and recombine even after the laser's beam is shut off, thereby improving the efficiency of the system, as explained later on.

Figure 7:
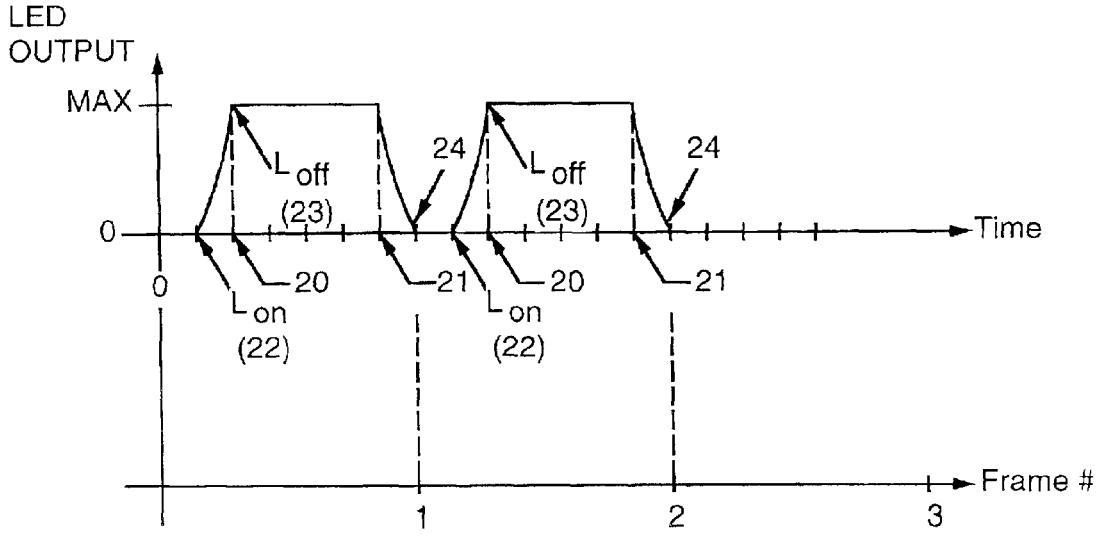
FIG. 7 is a graphical representation of the on-off cycles of the scanning laser and the applied electric field, in accordance with one embodiment of the present invention.
Figure 13:
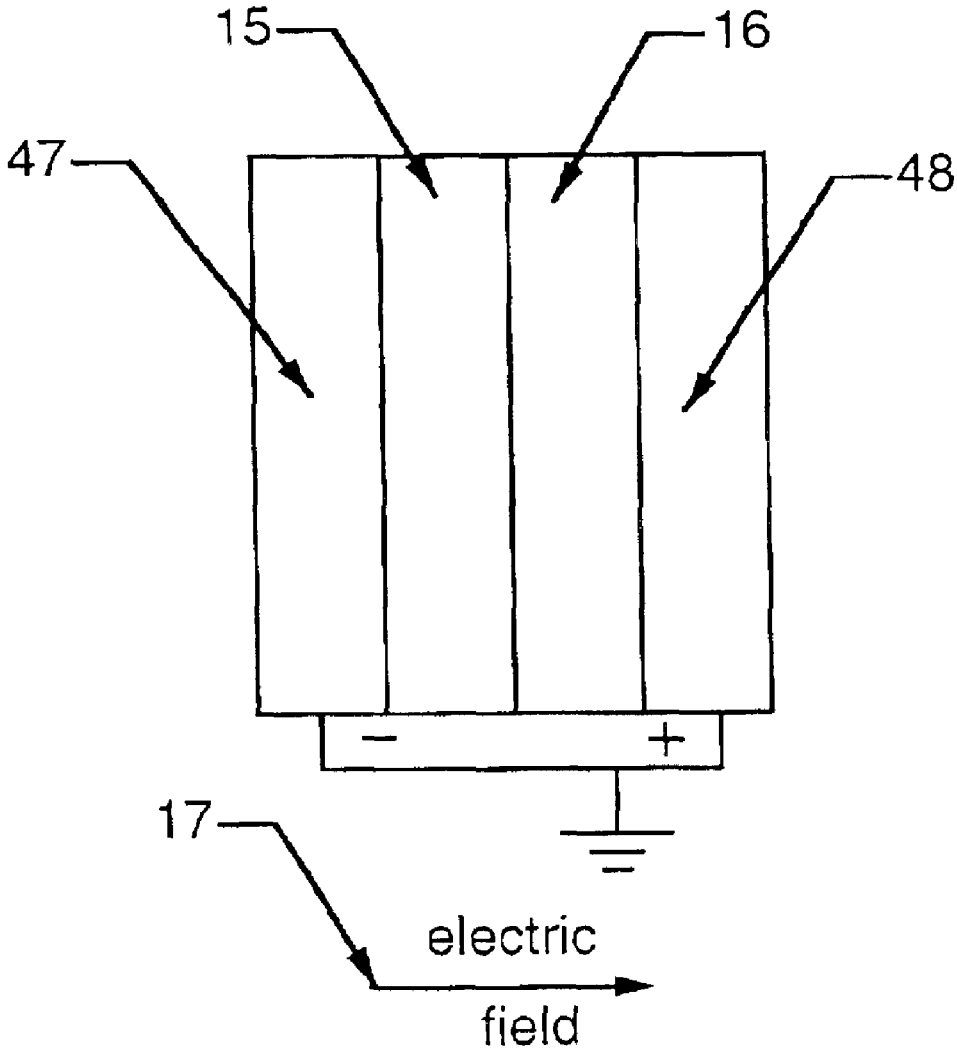
FIG. 13 illustrates the grounding or shorting electrodes to remove capacitance in accordance with one embodiment of the present invention.

In another embodiment of the invention, the electric field can be manipulated to control the on-off cycles of pixels in the display screen, as illustrated in FIG. 7. With the electric field applied, the laser is directed at a selected photocell and turned on at 22 then off at 23 (the laser's on-off cycle), during which time a capacitance or charge is built up in the photocell region 15 (FIG. 5). This produces a steady flow of current from duration 20 to 21 which illuminates the LED's, at which time 21 the electric field is turned off to complete a single frame of the display. Throughout duration 20 to 21 the LED's output will be at its maximum. At the end of every frame 21, the electric field is shut off for every pixel then turned back on prior to the scanning laser passing over each photodiode for the subsequent frame. Once the electric field is turned off 21, the LED's output drops rapidly to zero 24, as there is no longer the energy in the system to produce substantial quantum efficiency for a sustained LED output. This cycle repeats itself in subsequent frames for all pixels on the display screen 4 to have their connected LED regions illuminated. The reason for turning off the electric field is primarily due to the effect of residual capacitance in the system. The laser is applied for a very short duration compared to that of each frame period, and each time the electric field is shut off is because of this capacitance in the system. This capacitance may cause the light to take a while to decay off, thus to remove this the effect of residual capacitance in the system and to immediately shut off all light for any frame period, the electric field 17 must be shut off or shorted as further explained by FIG. 13. The photocell 15 and LED 16 combination with respective electrodes 47 & 48 are in the presence of an electric field 17. By shorting the two electrodes together or by grounding one or both electrodes, the residual capacitance in the system may be instantly removed and all light immediately shut off. This is required for each frame displayed. Another reason for shorting the two electrodes together or by grounding one or both electrodes is to remove the feedback loop generated between the LED 16 and photocell 15, as light from the LED produces more current flow from the photocell.

Figure 8:
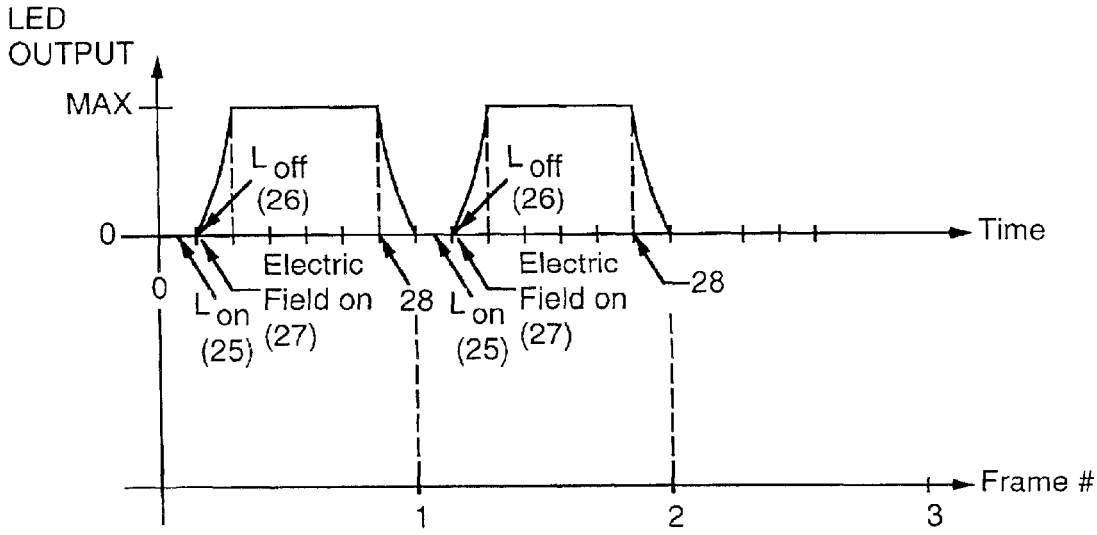
FIG. 8 is a graphical representation of the on-off cycles of the scanning laser and the applied electric field, in accordance with another embodiment of the present invention.

In another embodiment of the invention which refers further to FIG. 8, the electric field is manipulated to turn the LED's on and off for each frame period, utilizing a memory effect within the photocell region 15 (FIG. 5) of the device. As the laser scans selected photocell regions 15 on the display screen 4 throughout duration 25 to 26 (the laser's on-off cycle), there is a charge or capacitance buildup and carriers or electron-hole pairs move in all directions away from and towards the n-p barrier 18, even after the laser beam is turned off. The movement of these electron-hole pairs in the presence of the charge or capacitance buildup is of sufficient energy to keep them in motion or to continue generation of new electron-hole pairs for the duration the external electric field is turned off, hence creating a memory effect. Once the electric field is turned on at 27, the electron-hole pairs accelerate and migrate across the n-p barrier 18 with sufficient energy creating a current flow, thus turning on the LED's to maximum illumination. Cutting off the electric field at 28 would reduce the quantum efficiency of the device, turning off the LED's thus ending that particular frame at 28.

Figure 11:
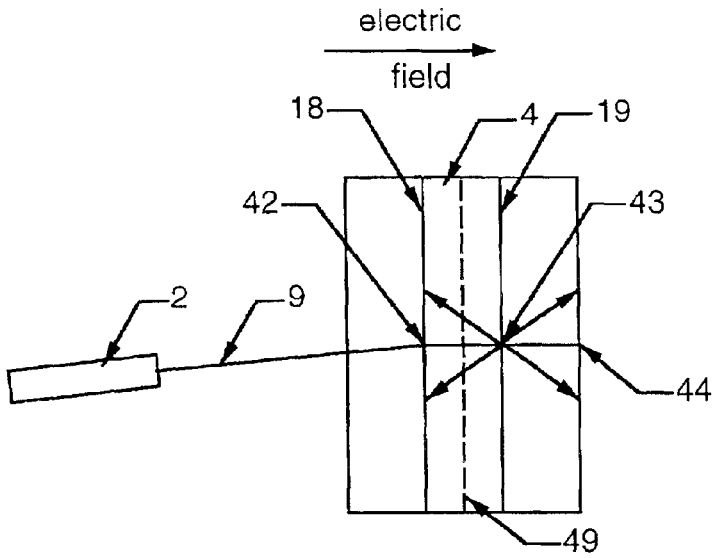
FIG. 11 illustrates the generation of carriers and light to produce an output on the display screen.
Figure 12:
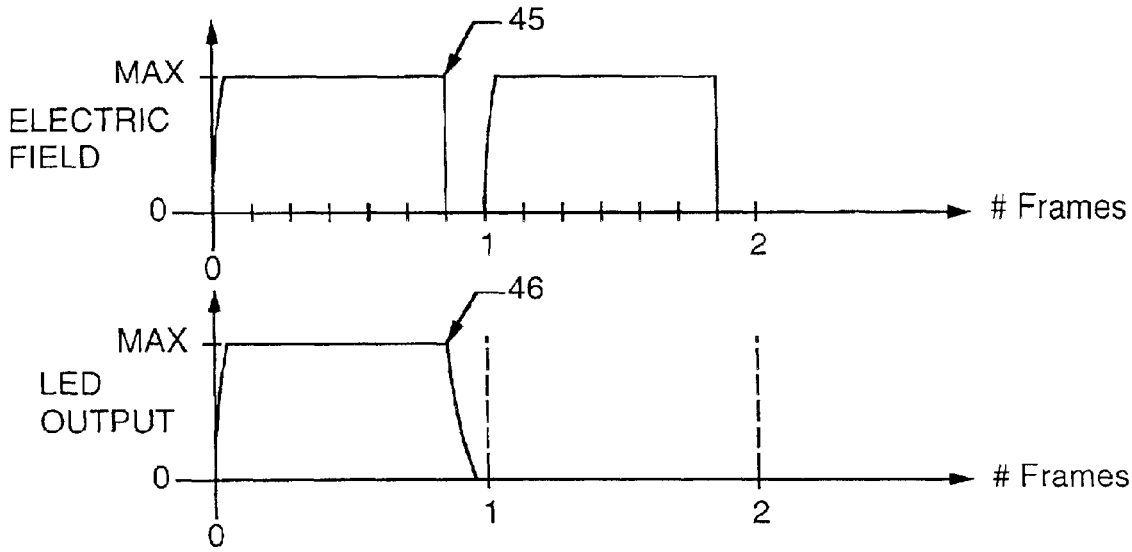
FIG. 12 illustrates the effect of the LED output by shutting off the electric field.

In another embodiment of the present invention, with reference to FIG. 11, the laser 2 emits a beam 9 onto the display 4 whereby carriers are generated and light is emitted in all directions. As the scanning laser's light particles or photons strike the display screen 4 in the photocell region 42 the carriers are generated which will then migrate under the action of the electric field across the barriers 18 and 19, and recombine with other carriers at location 43 to generate a light output at the LED region 44. However, light that is generated travels in all directions and also strikes the display screen 4 in the photocell region 42, thus more carriers are generated and a feedback loop is created for producing carriers. Since the LED output is proportional to the number of carriers generated, this method efficiently creates a high intensity output from the process started by the laser 2. The LED output is sustained until the electric field is shut off near the end of each frame period, and the electric field resumed prior to starting the next frame. With further reference to FIG. 12, the electric field is at full strength at the beginning of each frame period, and consequently the generated carriers migrate to produce a light output sustained at maximum output until the electric field is shut off at 45, whereby almost immediately after, the LED output drops from maximum at 46 down to zero at the end of each frame.

In another embodiment of the present invention, the light does not travel in all directions to generate the feedback loop. The capacitance in the system is sufficient to keep the light illuminated for each frame period. To prevent the light from travelling back from the LED to the photocell region to generate the feedback loop, there is an optical barrier 49 (FIG. 11) which blocks all light waves from reaching the photocell region 42.

Figure 9:
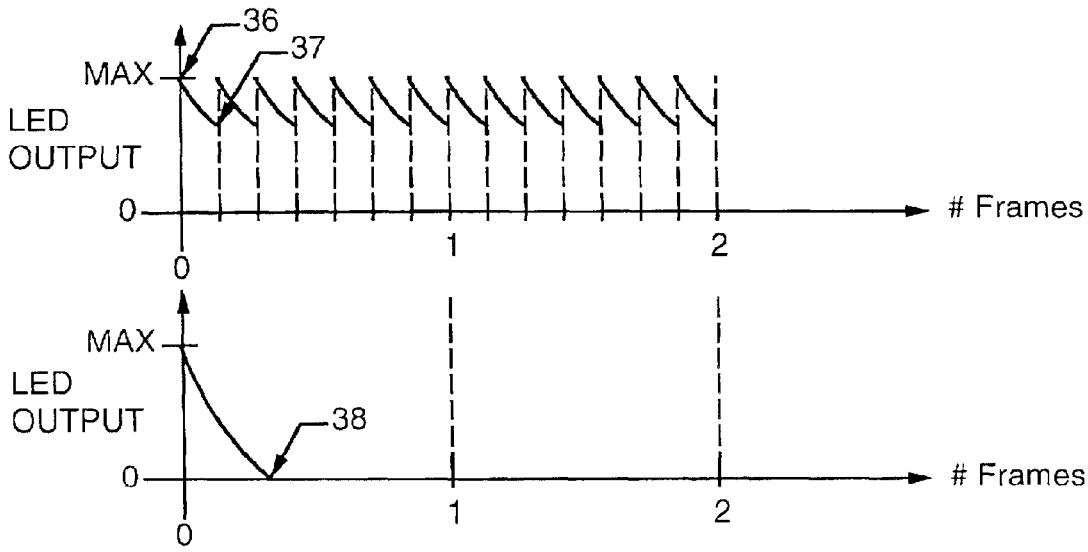
FIG. 9 illustrates the laser addressing all pixels on the display screen multiple times per frame period.

In a further embodiment of the present invention, with the aid of FIG. 9, each pixel is addressed many times per frame as the laser scans each pixel on the display. This method is particularly useful in instances where the capacitance in the system may not have the efficiency to sustain the LED output for the entire duration of each frame. As the laser is applied to a particular pixel location, the LED output would quickly reach its maximum or peak value. Hence, for the first frame to be displayed, as the laser hits the display screen the LED output at a particular pixel rapidly reaches it maximum value 36. Each time the LED output for that particular pixel drops to level 37, the laser would address the same pixel again for the LED output to reach its maximum value. This process cycles many times per frame, with the laser addressing all pixels on the display between the time at 36 and 37. In such instances where the capacitance in the system may not have the efficiency to sustain the LED output for the entire duration of each frame, the LED output for a particular pixel may rapidly drop to zero 38 and would not last for each frame period, significantly affecting the quality of display. Hence, the laser 2 addresses all pixels on the display screen 4 multiple times per frame period.

Figure 10:
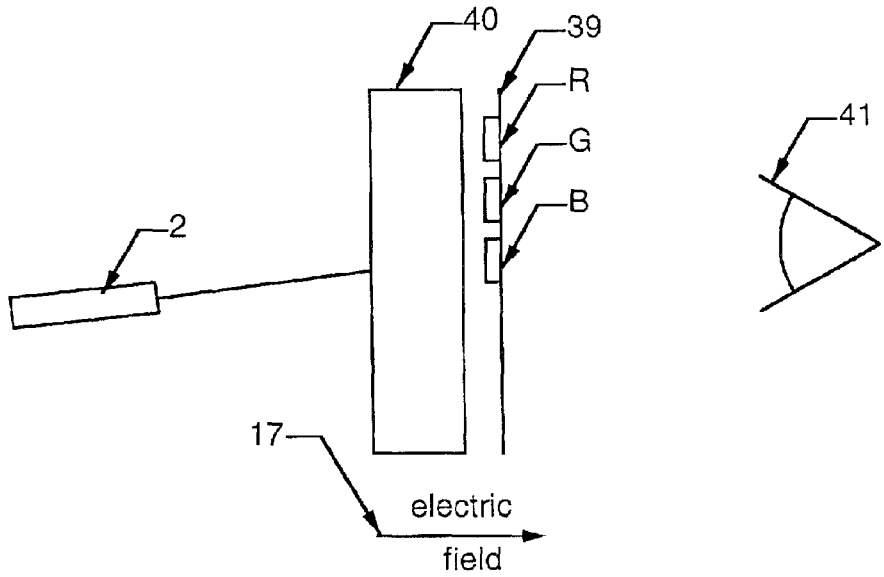
FIG. 10 illustrates the display screen comprised of a single color monolithic construction with an overlaying red, green and blue phosphor pattern.

In another embodiment of the invention, with reference to FIG. 10, the display screen is comprised of a single color monolithic construction display device 40 onto which another screen 39 comprising patterned red, green and blue phosphors is placed. This being significantly different from the screen construction of FIG. 4, operates in a similar fashion as described in previous embodiments, with a single color output from each pixel on the monolithic display device 40, which is primarily a photocell 15 and LED 16 combination, with an applied electric field 17. Hence, the monolithic display device emits the same color light at pixels where the laser's beam hits the display screen 40, and this light is directed to screen 39 comprising patterned red, green and blue phosphors which absorb the same color light and re-emits the light of a different color depending on which color (red, green or blue) phosphor is in front it. Hence a color display device is constructed from a monolithic light source combined with a matrix array of a patterned red, green and blue phosphor layer, and is presented to the user 41 who views the display device on the opposite side as the laser 2.

I claim:

1. A solid state optically addressable image generating and rendering device which constitutes a monolithic fabrication comprising of a photo-sensitive region and a photo-emissive region and which is configured to:

be addressed on the photo-sensitive region by a projector projecting light in presence of an applied electric field;

have the projected light cause a flow of charge carriers from the light affected photo-sensitive region to the photo-emissive region to cause a light emission;

exhibit stationary images as picture or picture frames wherein a frame is an integrated composition of the resultant light emissions from the device and a frame period represents time elapsed between the start of two consecutive frames.

2. The device as claimed in claim 1 whereby an optical barrier is positioned between the photo-sensitive region and photosensitive region to prevent feedback of light.

3. The device as claimed in claim 1 such that the light emitted by the photo-emissive region is absorbed and retransmitted by phosphors positioned against the photo-emissive region of the display, with an alternating pattern of red, green and blue, to form a color display.

4. The device as claimed in claim 1 whereby a capacitance in the device sustains the light emission output for all picture elements, after the projector has completed projecting light for each picture frame.

5. The device as claimed in claim 1 such that the electric field is turned off or grounded at the end of each picture frame causing the light output to be substantially terminated.

6. An optically addressable image generating and rendering device that exhibits stationary images as picture frames wherein a frame is an integrated composition of a resultant light emission from the device and a frame period is time elapsed between the start of two consecutive frames and wherein the whole device constitutes a monolithic fabrication comprising of a photo-sensitive region and a photo-emissive region such that the device is configured to:

be addressed on the photo-sensitive region by a projector projecting light in presence of an applied electric field;

have the projected light cause a voltage barrier to be lowered which causes a flow of charge carriers from the light affected photo-sensitive region to the photo-emissive region to cause a light emission.

7. The device as claimed in claim 6 whereby an optical barrier is positioned between the photo-emissive region and photosensitive region to prevent feedback of light.

8. The device as claimed in claim 6 such that the light emitted by the photo-emissive region is absorbed and retransmitted by phosphors positioned against the photo-emissive region, with an alternating pattern of red, green and blue, to form a color display.

9. The device as claimed in claim 6 whereby a capacitance in the device sustains the light emission output for all picture elements, after the projector has completed projecting light for each picture frame.

10. The device as claimed in claim 6 such that the electric field is turned off or grounded at the end of each picture frame causing the light output to be substantially terminated.

11. An optically addressable image generating and rendering device that exhibits stationary images as picture frames wherein a frame is an integrated composition of a resultant light emission from the device and a frame period is time elapsed between the start of two consecutive frames and wherein the whole device constitutes a monolithic fabrication comprising of a photo-sensitive region and a photo-emissive region such that the device is configured to:

be addressed on the photo-sensitive region by a projector projecting light in presence of an applied electric field;

have the projected light cause an amplified amount of charge carriers to flow, compared with those generated by the projected light, from the light affected photo-sensitive region to the photo-emissive region to cause a light emission.

12. The device as claimed in claim 11 whereby an optical barrier is positioned between the photo-emissive region and photosensitive region to prevent feedback of light.

13. The device as claimed in claim 11 such that the light emitted by the photo-emissive region is absorbed and retransmitted by phosphors positioned against the photo-emissive region, with an alternating pattern of red, green and blue, to form a color display.

14. The device as claimed in claim 11 whereby a capacitance in the device sustains the light emission output for all picture elements, after the projector has completed projecting light for each picture frame.

15. The device as claimed in claim 11 such that the electric field is turned off or grounded at the end of each picture frame causing the light output to be substantially terminated.

16. An optically addressable image generating and rendering device which constitutes a monolithic fabrication comprising of a photo-sensitive region and a photo-emissive region that is configured to:

be addressed on the photo-sensitive region via a laser scan in presence of an applied electric field;

have the laser scan on an area effect a flow of charge carriers from the photo-sensitive to the photo-emissive region to cause a light emission that defines a pixel or a picture element;

exhibit stationary images as picture frames wherein a frame is an integrated composition of the resultant light emissions from the device and a frame period represents time elapsed between the start of two consecutive frames;

to continue light emission via a capacitance, at the photo-sensitive region, for a frame period allowing for brighter overall output over multiple frames.

17. The device as claimed in claim 16 wherein the device acquires a capacitance at the photo-sensitive region which enables charge carriers to flow even when the laser has stopped scanning thereby causing light to emit from the photo-emissive region for a period of time substantially greater than a period in which the laser is incident on the photo-emissive region.

18. The device as claimed in claim 16 such that the capacitance does not enable the picture elements to continuously emit light for a frame period after a single scan, the laser beam scans each picture element multiple times in one frame period to substantially sustain light output from the picture elements for the frame period.

19. The device as claimed in claim 16 such that a feedback of lights from the photo-emissive region to the photo-sensitive region sustains the light emission output, for each picture frame.

20. The device as claimed in claim 16 such that an optical barrier is positioned between the photo-emissive region and photo-sensitive region to prevent feedback of light.

21. The device as claimed in claim 16 such that the electric field is turned off at the end of each picture frame causing the light output to be substantially terminated.

22. The device as claimed in claim 16 such that the electric field is grounded at the end of each picture frame which causes the light output to be substantially terminated.

23. The device as claimed in claim 16 such that the output of emitted light is substantially near zero, for each picture element, at the beginning of each frame period.

24. The device as claimed in claim 16 such that a photo generated charge carrier creates a avalanche of carriers through an impact ionization process which results in a high intensity light output.

25. The device as claimed in claim 16 such that the light emitted by the photo-emissive region passes through color filters positioned against the photo-emissive region to form a RGB display.

26. The device as claimed in claim 16 such that the light emitted by the photo-emissive region is absorbed and retransmitted by phosphors positioned against the photo-emissive region, with an alternating pattern of red, green and blue, to form a color display.

27. An optically addressable image generating and rendering device which constitutes a monolithic fabrication comprising of a photo-sensitive region and a photo-emissive region that is configured to:

be addressed on the photo-sensitive region via a laser scan in presence of an applied electric field;

have the laser scan on an area effect a flow of charge carriers from the photo-sensitive to the photo-emissive region to cause a light emission that defines a pixel or a picture element;

exhibit stationary images as picture frames wherein a frame is an integrated composition of the resultant light emissions from the device and a frame period represents time elapsed between the start of two consecutive frames.

* * * * *